US005084308A

United States Patent [19]

Luk

[11] Patent Number: 5,084,308

[45] Date of Patent: Jan. 28, 1992

[54] SHEET MATERIAL FOR ARTIFICIAL PLANTS

[75] Inventor: Kwai L. Luk, Hong Kong, Hong Kong

[73] Assignee: Fung Yue Industrial Company Limited, New Territories, Hong Kong

[21] Appl. No.: 615,356

[22] Filed: Nov. 19, 1990

[30] Foreign Application Priority Data

Jan. 12, 1990 [GB] United Kingdom ..... 9000741

[51] Int. Cl.[5] ..... A41G 1/00

[52] U.S. Cl. ..... 428/17; 428/23

[58] Field of Search ..... 428/15, 17, 23; 156/61

[56] References Cited

U.S. PATENT DOCUMENTS

| | | | |
|---|---|---|---|
| 3,759,769 | 9/1973 | Oshima | 428/17 X |
| 4,201,806 | 5/1980 | Cole | 428/4 |
| 4,221,500 | 9/1980 | Garrett | 428/17 X |
| 4,808,446 | 2/1989 | Weitz | 428/17 |

*Primary Examiner*—Henry F. Epstein

*Attorney, Agent, or Firm*—Sandler, Greenblum & Bernstein

[57] ABSTRACT

Slits extend transversely between longitudinal edge portions of a PVC sheet to define two interdigitating rows of triangular regions, each row having its apexes integral with one edge portion and its bases integral with the other edge portion. Crease lines extend along the respective triangular regions. When the apexes are separated, two pieces of bladed sheet material are formed. The blades resemble grass or leaves.

14 Claims, 2 Drawing Sheets

SHEET MATERIAL FOR ARTIFICIAL PLANTS

FIELD OF THE INVENTION

This invention relates to sheet material for use in making artificial plants which may be used in decorating or in flower arranging, in particular to resemble bladed plants such as grasses and ferns or palms.

DISCLOSURE OF THE INVENTION

The invention provides a sheet material for making artificial plants, comprising an elongate sheet having longitudinal edge portions substantially free of slits and creases, slits extending transversely of the sheet between the longitudinal edge portions so as to define elongate triangular regions, there being two interdigitating rows of triangular regions, each row having its bases integral with one of the longitudinal edge portions and its apexes integral with the other of the longitudinal edge portions, and crease lines extending transversely of the sheet along the respective triangular regions.

When the apexes are separated from the respective longitudinal edge portions one obtains two pieces of a bladed sheet material comprising a row of elongate triangular regions side-by-side, with their bases integral with a longitudinal edge portion substantially free of slits and creases and with their apexes arranged along a line substantially parallel with the longitudinal edge portion, crease lines extending along the respective triangular regions.

The triangular regions resemble slim leaves or blades, with the creases representing veins and providing limited rigidity. The creases preferably occupy at least the major part of the length of the respective triangular regions.

The invention will be described further, by way of example, with reference to the accompanying drawings.

DETAILED DESCRIPTION OF PREFERRED EMBODIMENTS

The sheet material 1 shown in FIGS. 1 to 4 is made from green-colored polyvinyl chloride sheet of uniform thickness. Between two longitudinal edge portions 2*a*,2*b* of equal width, the sheet is formed with slanting slits 3 defining slim isosceles triangular regions 4*a*,4*b* arranged in two interdigitating rows. Each triangular region 4*a* (or 4*b*) has its apex 6*a* (or 6*b*) integral with the edge portion 2*a* (or 2*b*) and its base 7*a* (or 7*b*) integral with the opposite edge portion 2*b* (or 2*a*). The angle between the adjacent slits 3 is about 2° (or in the range 1° to 4°).

Each triangular region 4*a* (or 4*b*) is bisected by a crease line 8*a* (or 8*b*) which is perpendicular to the edge portions 2*a*,2*b* and which extends as far as the apex 6*a* (or 6*b*) and the base 7*a* (or 7*b*). As can be seen from FIGS. 2 and 4, the crease lines 8*a*,8*b* alternate as troughs (8*a*) and crests (8*b*). This facilitates manufacture of the sheet material, during which the creases and slits are preferably formed simultaneously by passing the PVC sheet material between rollers which crease the material and which carry blades for slitting the material.

Figure 1:
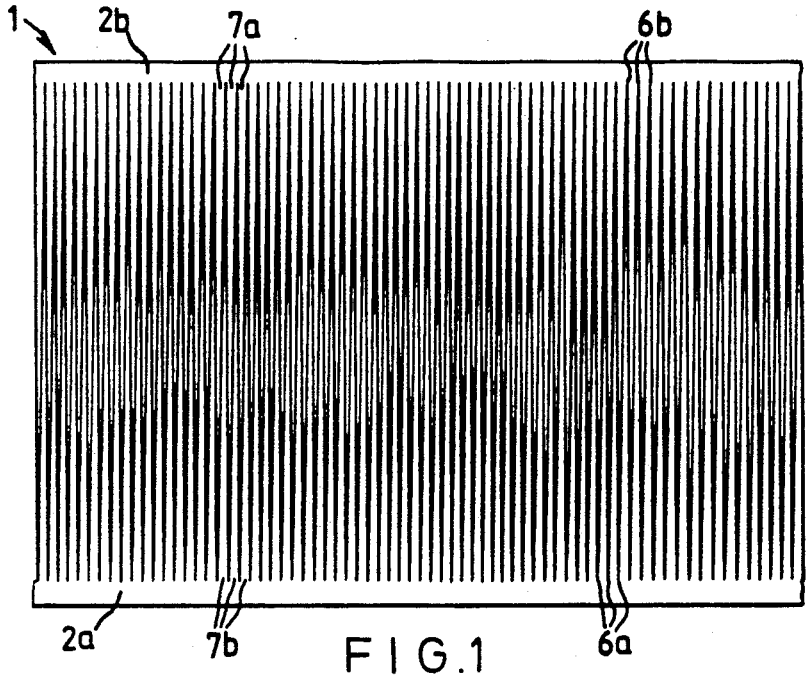
FIG. 1 is a plan view of a length of sheet material.
Figure 2:
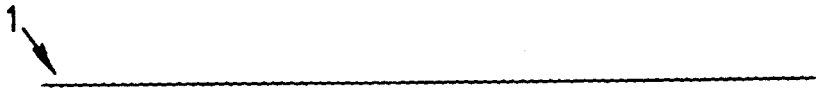
FIG. 2 is a side view of the sheet material.
Figure 4:
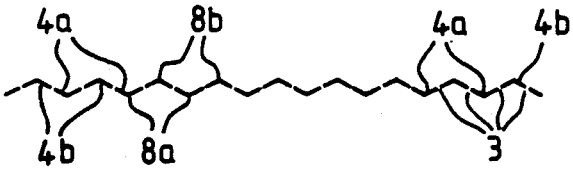
FIG. 4 is a section on line X—X in FIG. 3.
Figure 3:
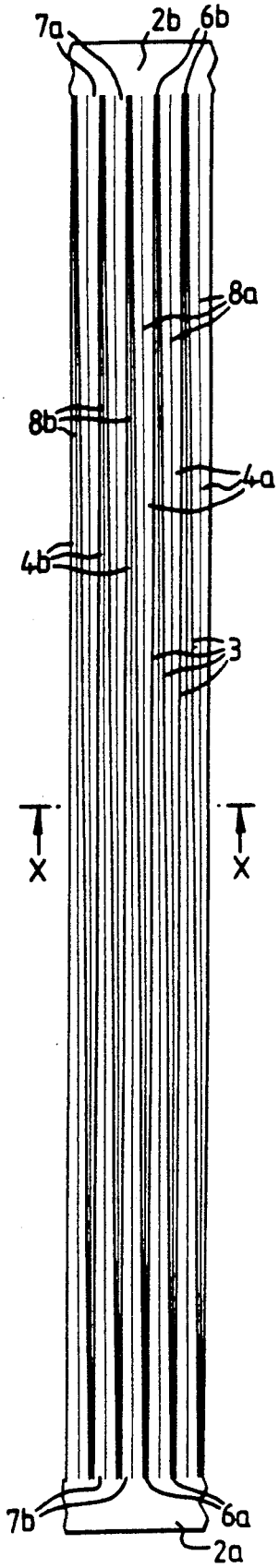
FIG. 3 is an enlarged detail of FIG. 1.
Figure 5:
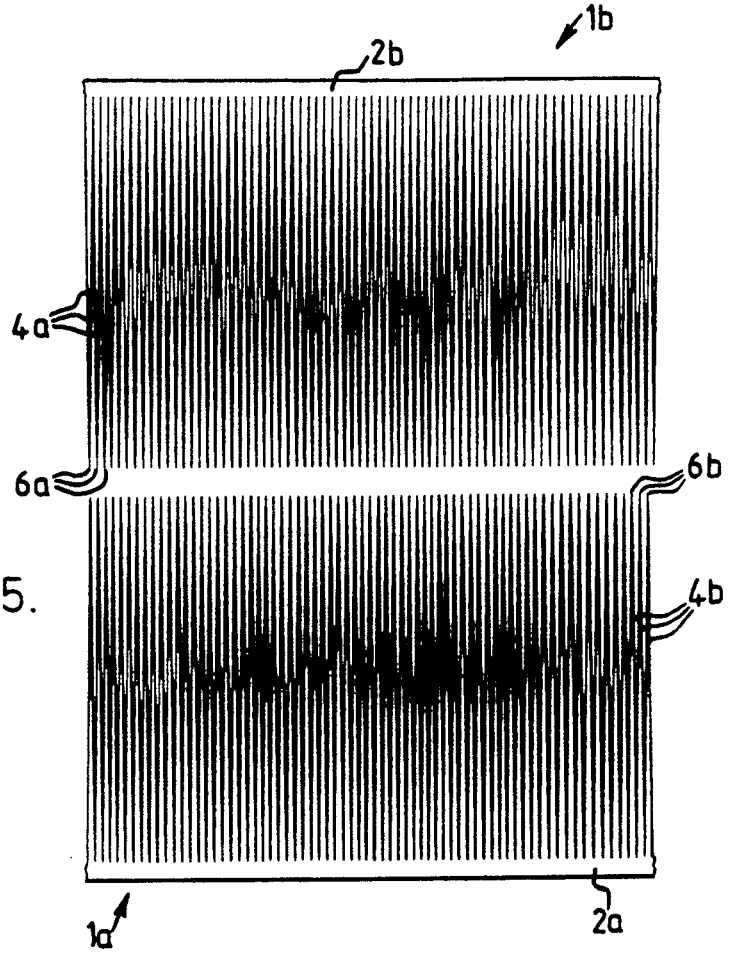
FIG. 5 is a plan view of two pieces of bladed sheet material formed from the material of FIG. 1.

By separating the apexes 6*a*,6*b* of the two rows of triangular regions 4*a*,4*b* from the respective edge portions 2*a*,2*b* one obtains two pieces 1*a*,1*b* of bladed sheet material as shown in FIG. 5. If the longitudinal edge portion 2*a* is held rigidly along a straight or curving line with the triangular regions 4*a* extending upwards, they will rest in such a way as to resemble onion grass, owing to the stiffening effect of the creases.

Figure 6:
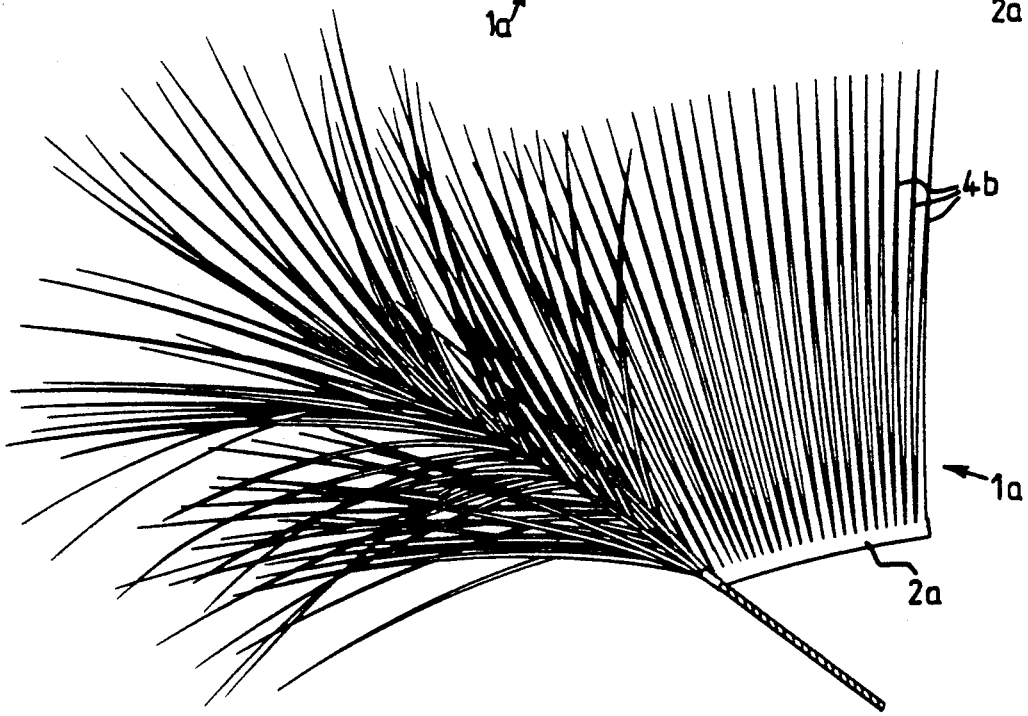
FIG. 6 shows an artificial plant being formed from the bladed sheet material.

As shown in FIG. 6, if the longitudinal edge portion 2*a* is wound helically on a wire stem 9, with the inside (trough) of the creases facing inwards, the triangular regions 4*b* can be made to resemble the leaves of a cycas plant.

I claim:

1. A sheet material for making artificial plants, comprising an elongate sheet having longitudinal edge portions substantially free of slits and creases, slits extending transversely of the sheet between the longitudinal edge portions so as to define elongate triangular regions, there being two interdigitating rows of triangular regions, each row having its bases integral with one of the longitudinal edge portions and its apexes integral with the other of the longitudinal edge portions, and crease lines extending transversely of the sheet along the respective triangular regions.

2. The sheet material of claim 1, in which the triangular regions are isosceles.

3. The sheet material of claim 1, in which the angle between adjacent slits is in the range 1° to 4°.

4. The sheet material of claim 1, in which the crease lines alternate as troughs and crests.

5. The sheet material of claim 1, in which the crease lines extend as far as the bases of the triangular regions.

6. The sheet material of claim 1, in which the crease lines extend as far as the apexes of the triangular regions.

7. The sheet material as claimed in claim 1, in which the edge portions and triangular regions are of the same thickness.

8. The sheet material of claim 1, in which the sheet consists of polyvinyl chloride.

9. A bladed sheet material comprising a row of elongate triangular regions side-by-side, with their bases integral with a longitudinal edge portion substantially free of slits and creases and with their apexes arranged along a line substantially parallel with the longitudinal edge portion, crease lines extending along the respective triangular regions.

10. The bladed sheet material of claim 9, in which the triangular regions are isosceles.

11. The bladed sheet material of claim 9, in which the apex angle of each triangular region is in the range 1° to 4°.

12. The bladed sheet material of claim 9, in which the crease lines extend as far as the bases of the triangular regions.

13. The bladed sheet material of claim 9, in which the crease lines extend as far as the apexes of the triangular regions.

14. An artificial plant comprising the bladed sheet material of claim 9 and a stem on which the bladed sheet material is wound, said longitudinal edge portion of the bladed sheet material extending helically along the stem.

* * * * *